US006558099B2

(12) United States Patent
Mendoza et al.

(10) Patent No.: US 6,558,099 B2
(45) Date of Patent: May 6, 2003

(54) REINFORCED BOOK BOUND WITH IMAGING MATERIAL

(75) Inventors: Gabriel Mendoza, Cupertino, CA (US); Israel Cruz, Jalisco (MX); David J. Arcaro, Boise, ID (US)

(73) Assignee: Hewlett-Packard Development Co., L.P., Houston, TX (US)

( * ) Notice: Subject to any disclaimer, the term of this patent is extended or adjusted under 35 U.S.C. 154(b) by 43 days.

(21) Appl. No.: 09/848,803

(22) Filed: May 3, 2001

(65) Prior Publication Data

US 2002/0163175 A1 Nov. 7, 2002

(51) Int. Cl.[7] ..... B42C 11/00

(52) U.S. Cl. ..... 412/1; 412/8; 412/4; 412/33; 412/37; 281/21.1; 281/15.1; 281/38; 283/63.1

(58) Field of Search ..... 281/15.1, 21.1, 281/29, 37, 36, 38; 412/1, 3, 4, 6, 8, 33, 37, 900, 902; 428/40.1; 283/63.1

(56) References Cited

U.S. PATENT DOCUMENTS 5,011,187 A * 4/1991 Hunder et al. ..... 281/29
6,040,026 A * 3/2000 Iwabuchi et al. ..... 428/40.1
6,394,728 B1 * 5/2002 Boss ..... 412/1

* cited by examiner

*Primary Examiner*—Willmon Fridie, Jr.

(57) ABSTRACT

A reinforced book assembled from a stack of media sheets and a cover. Each media sheet includes at least one binding region located adjacent to a binding edge of that media sheet. The binding region of each sheet is aligned with and faces a binding region of an adjacent media sheet. The cover extends at least partially over a first face of the stack, wraps around the binding edges of the media sheets, and extends at least partially over a second face of the stack. The book also includes activated imaging material on the binding region of each media sheet binding the media sheets together as well as activated imaging material on the cover binding the cover to the binding regions on the first and second faces of the stack.

20 Claims, 8 Drawing Sheets

REINFORCED BOOK BOUND WITH IMAGING MATERIAL

FIELD OF THE INVENTION

The present invention relates to binding together a stack of media sheets and a cover. More specifically, the invention relates to binding the sheets and cover using the same imaging material, toner, ink and the like, used to print the text or images on the sheets.

BACKGROUND OF THE INVENTION

Conventional methods to bind multiple pages together include stapling, clamping, gluing and sewing. Each of these methods add additional "mixed materials" to the final document. U.S. patent application Ser. No. 09/320,620 filed on May 26, 1999, entitled "Binding Sheet Media Using Imaging Material," hereby incorporated by reference, discloses a new method for binding media sheets using imaging material such as toner or ink. In addition to applying imaging material to each sheet in the form of text or other desired print image, imaging material is applied to a binding region of each sheet using a printer or other image forming device. The imaging material is activated. Where laser toner is used as the imaging material, the activation process is called fixing or fusing the toner. Then, the sheets are assembled for binding aligning the binging region on each media sheet with and facing a binding region on an adjacent sheet. The imaging material in the binding regions is then re-activated (re-fused if laser toner is used as the imaging material) to bind the sheets.

As illustrated in FIG. 1, the binding region 10 of each sheet 12 of booklet 14 is generally located along a binding edge 16 in the shape of a strip to maximize the area available on each sheet for text and graphics. However, as the size of the binding region decreases, so does the force required to destroy the bond. For example, with a five millimeter wide and two hundred seventy millimeter long binding region 10, the force required to destroy the bond is greater than the force required to destroy the sheets themselves when pulling sheet 12 perpendicularly away from the booklet 14. Referring to FIG. 3, the bond strength, however, is, in many instances, not sufficiently strong to withstand peeling. Moreover, attempting to open the booklet flat, as shown in FIG. 4 may destroy the bond in one or more locations.

What is needed is a reinforced book bound using imaging material that is capable of being opened flat and is not susceptible to peeling.

SUMMARY OF THE INVENTION

The present invention is directed to a reinforced book assembled from a stack of media sheets and a cover. Each media sheet includes at least one binding region located adjacent to a binding edge of that media sheet. The binding region of each sheet is aligned with and faces a binding region of an adjacent media sheet. The cover extends at least partially over a first face of the stack, wraps around the binding edges of the media sheets, and extends at least partially over a second face of the stack. The book also includes activated imaging material on the binding region of each media sheet binding the media sheets together as well as activated imaging material on the cover binding the cover to the binding regions on the first and second faces of the stack.

DESCRIPTION OF THE DRAWINGS

FIGS. 5–8 illustrate a first embodiment of the present invention, while

FIG. 1 is an isometric view of a booklet having a binding region in the shape of a strip along the binding edge of each sheet.

FIG. 2 is an isometric view of the booklet of FIG. 1 with a cover sheet being pulled perpendicularly from the booklet.

FIG. 3 is an isometric view of the booklet of FIG. 1 with a cover sheet being peeled from the booklet.

FIG. 4 is an isometric view of the booklet of FIG. 1 opened flat damaging the bond.

FIG. 5 is a top plan view of the inside of a flattened cover according to the first embodiment.

FIG. 6 is an isometric view of a plurality of media sheets to be assembled and bound into a stack according to the first embodiment.

FIG. 7 is an isometric view of a cover to be assembled with and bound to the stack formed by assembling and binding the media sheets of FIG. 6.

FIG. 8 is an isometric view of a book formed by binding the cover to the bound stack of media sheets according to the first embodiment.

FIG. 9 is a top plan view of a media sheet according to the second embodiment.

FIG. 10 is an edge view of a stack of unbound media sheets according to the second embodiment.

FIG. 11 is an edge view of a stack of bound media sheets according to the second embodiment.

FIG. 12 is an edge view of a booklet formed by nesting the bound stack of media sheets in FIG. 11.

FIG. 13 is a top plan view of a flattened book cover according to the second embodiment.

FIG. 14 is a side plan view of a group of booklets being assembled into a stack to be bound to the cover of FIG. 13.

FIG. 15 is an edge view of an assembled stack of booklets to be assembled and bound with a cover according to the second embodiment.

FIG. 16 is an edge view of a book formed by binding the cover to the assembled stack of booklets according to the second embodiment.

DETAILED DESCRIPTION OF THE INVENTION

FIGS. 5–8 illustrate the construction of a reinforced book using imaging material to bind a cover to a stack of bound sheets. The addition of the cover adds strength while providing a professional appearance.

Figure 1:
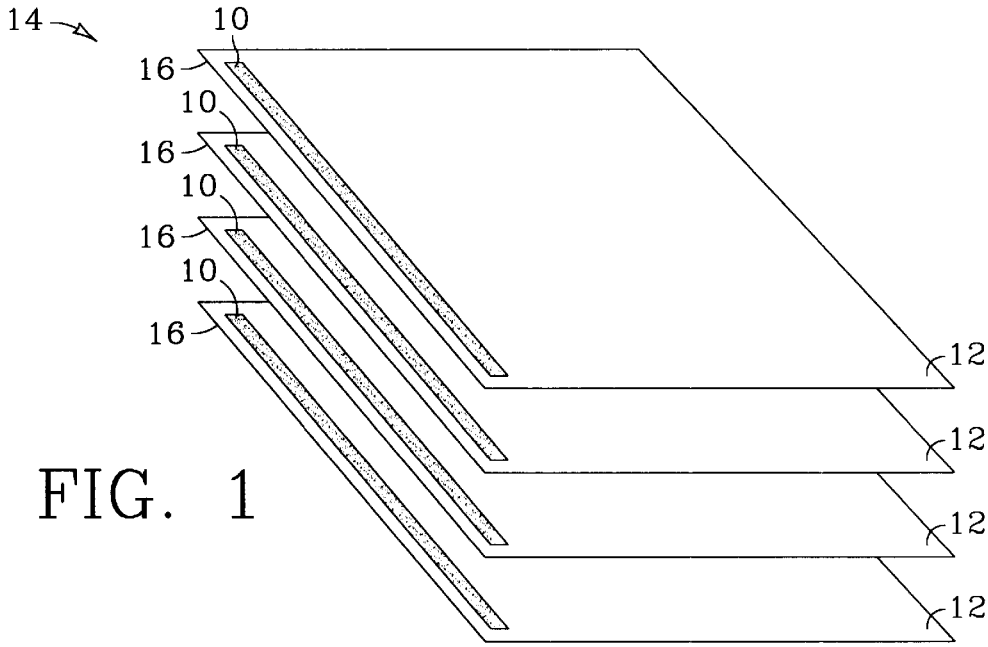
FIGS. 1–4 illustrate a booklet formed without a cover.
Figure 2:
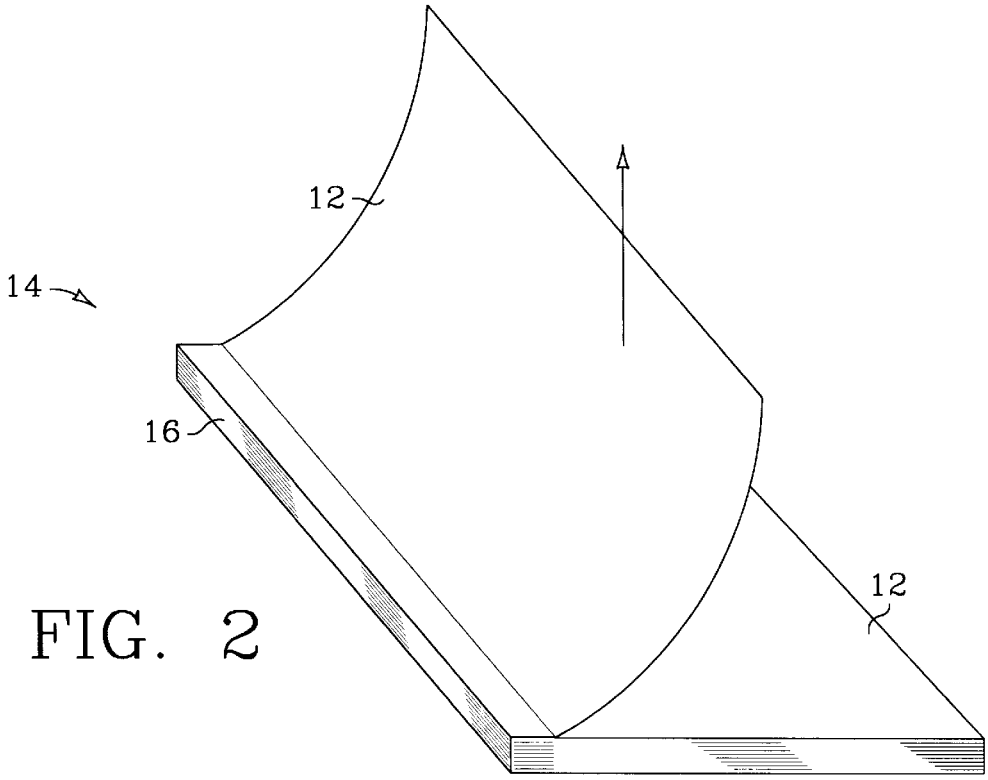
Figure 3:
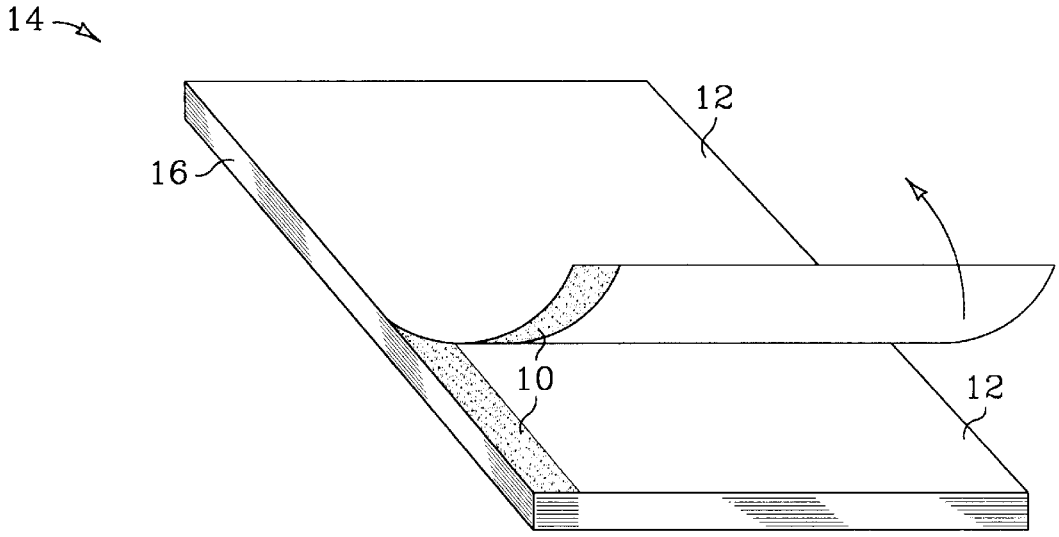
Figure 4:
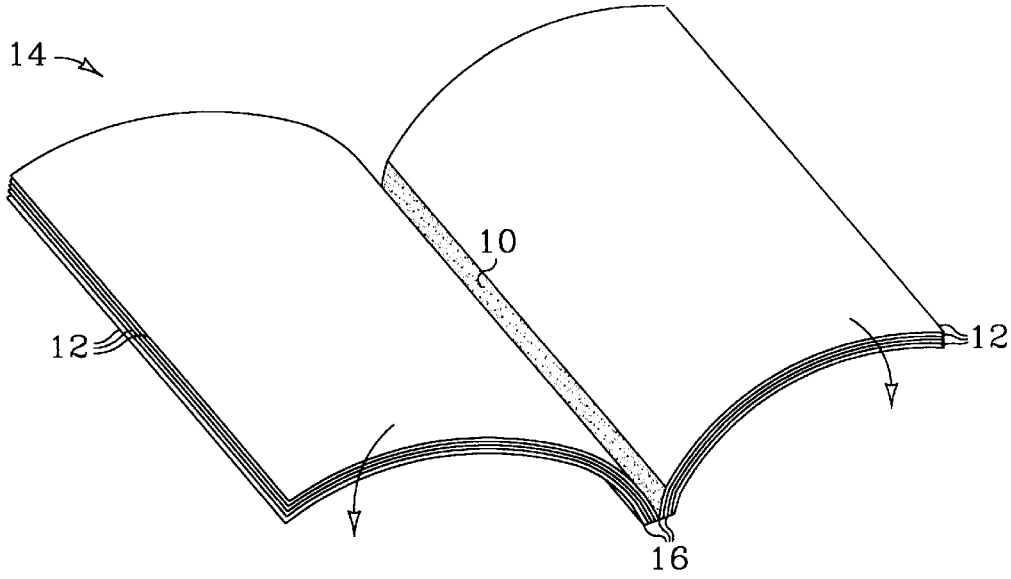
Figure 5:
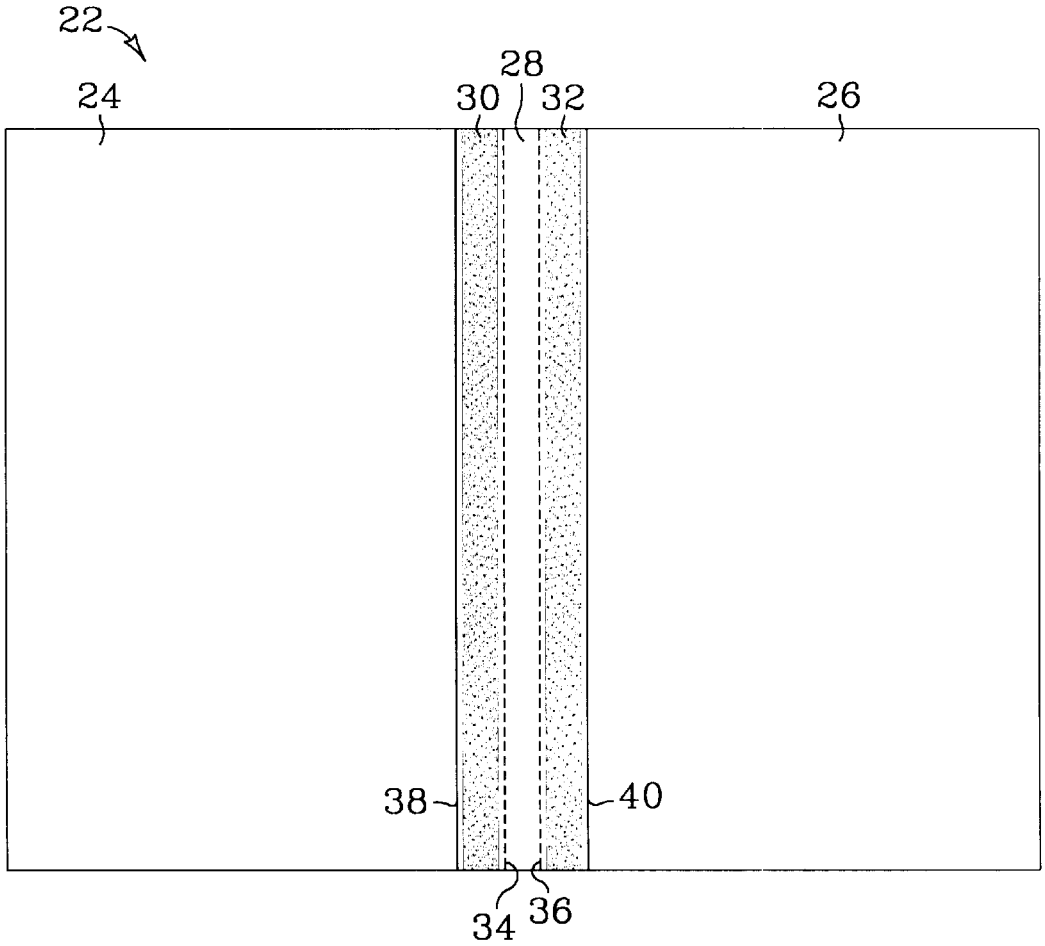

Referring first to FIG. 5, cover 22 includes first and second flaps 24 and 26, spine 28, first and second binding regions 30 and 32, first and second folds 34 and 36, and first and second scores 38 and 40. Spine 28 is located between first and second folds 34 and 36. First binding region 30 is located between first fold 34 and first score 38 while second binding region 32 is located between second fold 36 and second score 40. Spine 28 and first and second flaps 24 and 26 include portions of both faces of cover 22. A third binding region, not shown, may be located on one side of cover 22 along spine 28 between first and second binding regions 30 and 32.

Initially, cover 22 will be passed through an image forming device such as a printer or copier. Using well known technology, the image forming device deposits imaging material such as toner or ink to binding regions 30 and 32. The image forming device may also deposit imaging material in the form of a desired print image on one or both faces of cover 22. The deposited imaging material is then activated or fused to cover 22, and cover 22 is dispensed from the image forming device.

Figure 6:
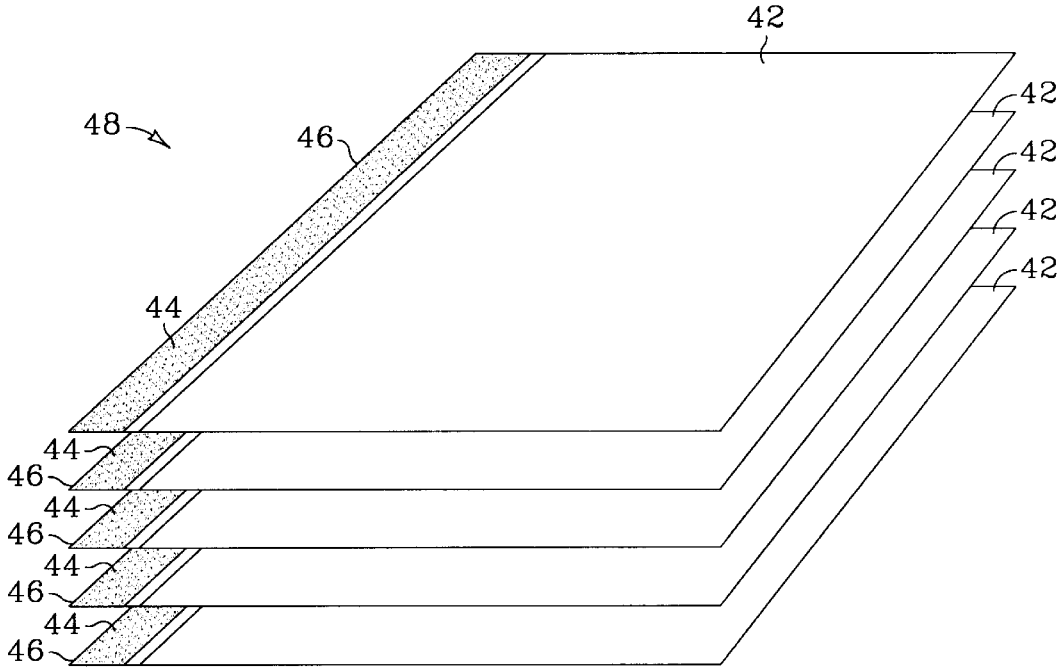

Referring next to FIG. 6, the pages, or sheets 42 of the book are printed and assembled. Each sheet 42 includes binding region 44 and binding edge 46. It is envisioned that binding region 44 will be a strip located generally adjacent to and parallel with binding edge 46. Binding region 44 may be located on one or both faces of sheet 42. Like cover 22, each sheet 42 is initially passed through an image forming device where imaging material is deposited on binding region 44. Imaging material may also be deposited in the form of a desired print image on one or both faces of sheet 42. The imaging material is then activated or fused to each sheet 42. Sheets 42 are then assembled into stack 48, aligning binding edges 46 and binding regions 44 of each adjacent sheet. The binding regions 44 of sheets 42 are pressed together and the imaging material deposited to those regions is reactivated, thus, binding sheets 42. For example, when toner is used, binding regions 44 are heated sufficiently to cause the toner to melt. As the toner cools, it solidifies adhering to binding regions 44 of adjacent sheets 42.

Figure 7:
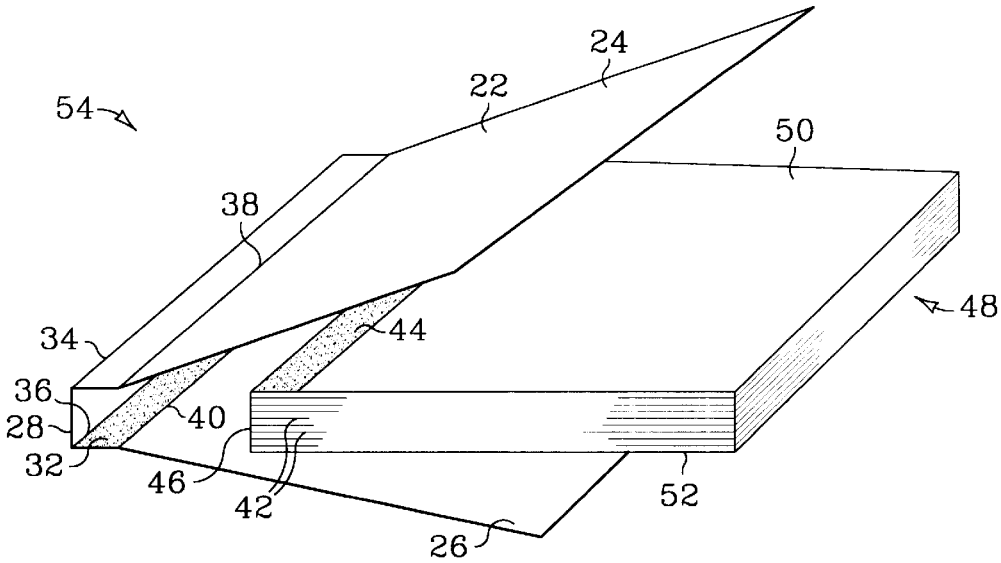
Figure 8:
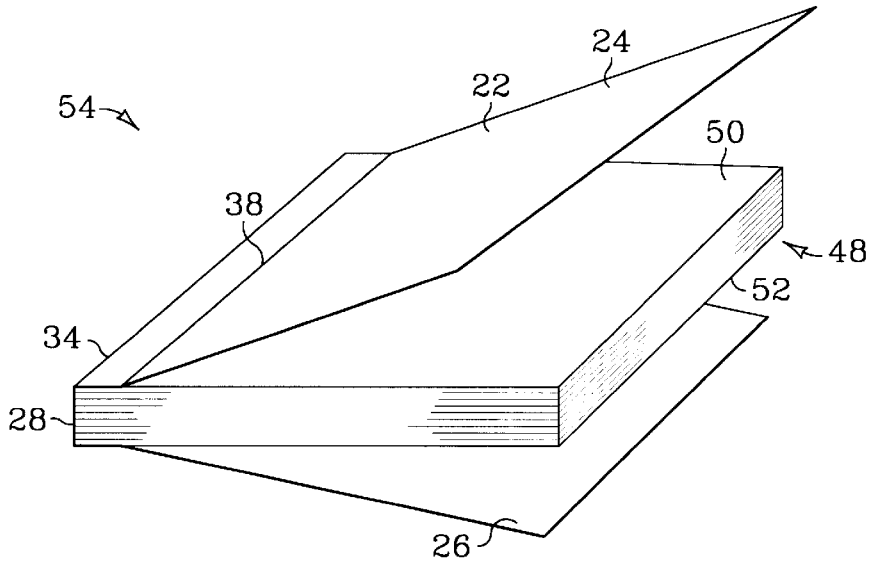

Referring now to FIGS. 7 and 8, cover 22 is assembled with and bound to stack 48. First flap 24 of cover 22 extends over a first face 50 of stack 48 while second flap 26 of cover 22 extends across a second face 52 of stack 48. With cover 22 bent at folds 34 and 36, spine 28 abuts and faces binding edges 46 of sheets 42 while aligning binding regions 30 and 32 with binding regions 44 of the outer sheets in stack 48. The imaging material deposited to cover binding regions 30 and 32 is then reactivated to bind cover 22 to stack 48 and complete the assembly of book 54. Instead of two separate steps, cover 22 could be bound to stack 48 at the same time sheets 42 are bound to one another It is envisioned that cover 22 will be constructed of heavier material than sheets 42. Cover 22 provides a professional appearance while helping prevent sheets 42 from peeling off stack 48. Scores 40 and 42 also help prevent peeling by allowing first and second flaps 24 and 26 to be folded away from stack 48 without pulling on the binding. The bond strength of book 54 depends largely upon the area encompassed by the binding regions on cover 22 and sheets 42. It also depends upon the degree of reactivation and the density of the imaging material applied to binding regions 30, 32, and 34.

The construction of a second embodiment of a reinforced book is illustrated in FIGS. 9–16. This second embodiment involves assembling a stack of individual booklets (illustrated in FIGS. 9–12) and binding that stack to a cover (illustrated in FIGS. 13–16). The novel assembly of each booklet and the addition of the cover allow the book to be opened relatively flat while maintaining a superior bond strength.

Figure 9:
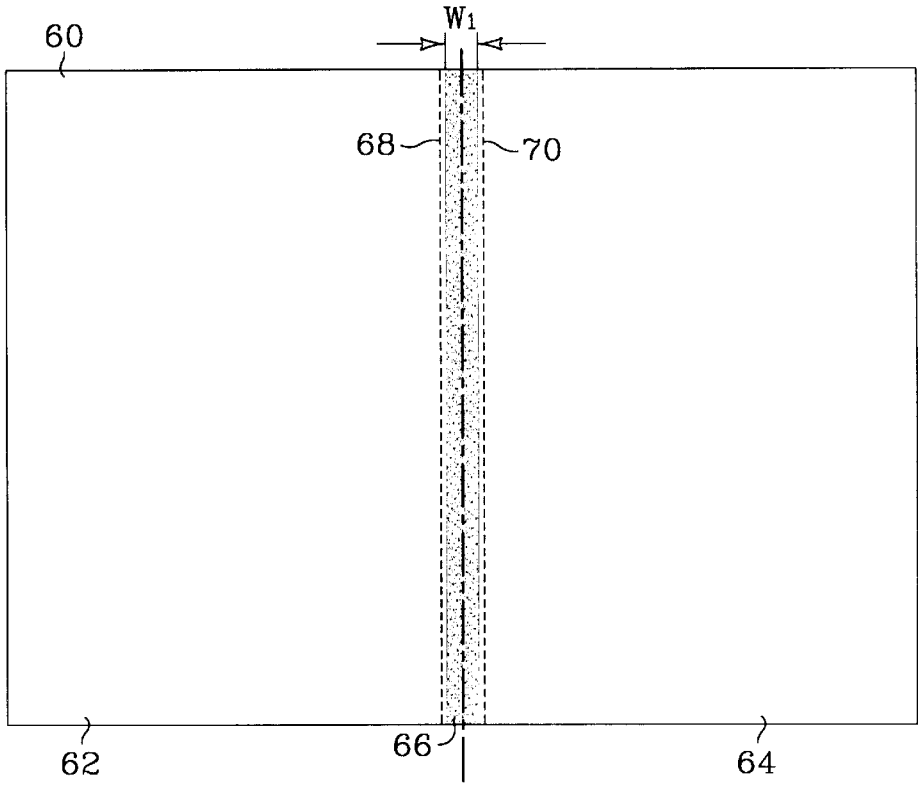
FIGS. 9–16 illustrate a second embodiment of the present invention. Specific descriptions of each figure are provided below.

Referring first to FIG. 9, each booklet is comprised of a plurality of media sheets 60. Each media sheet 60 includes first region 62, second region 64, and binding region 66 located between and joining first and second regions 62 and 64. First fold 68 is located along the intersection of first region 62 and binding region 66. Second fold 70 is located along the intersection of second region 64 and binding region 66. Initially, each media sheet 60 is passed through an image forming device where imaging material is deposited on binding region 66. Imaging material may also be deposited and on one or both faces of media sheet 60 in the form of a desired print image. The imaging material is then activated and fused to media sheet 60.

Figure 10:
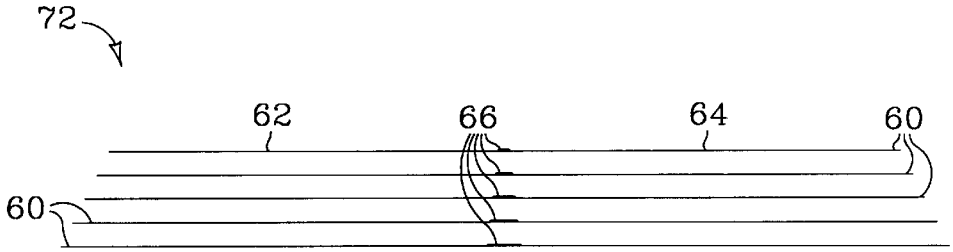
Figure 11:
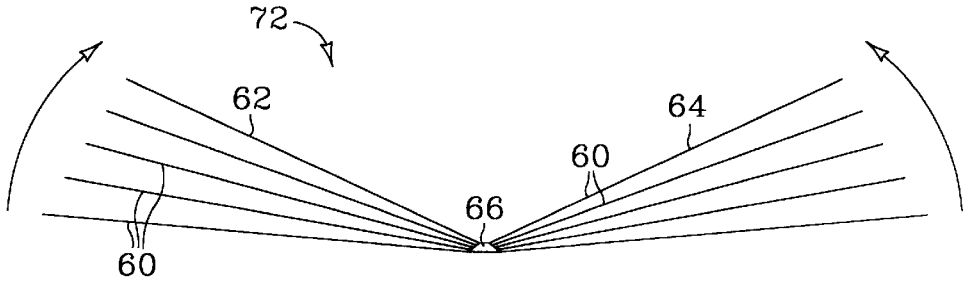
Figure 12:
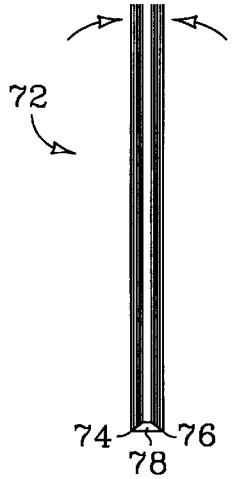

After each media sheet 60 is dispensed from the imagine forming device, media sheets 60 are assembled and nested as illustrated in FIGS. 10 and 11. First region 62, binding region 66, and second region 64 of each media sheet 60 are aligned to face the corresponding regions of each adjacent media sheet. Binding regions 66 are pressed together and the imaging material deposited to binding regions 66 is reactivated, binding the media sheets. Media sheets 60 are nested to form booklet 72 by folding media sheets 60 along folds 68 and 70 as shown in FIGS. 11 and 12.

The width W1 of binding region 66 of each nested media sheet varies in accordance to its particular placement within booklet 72. The width W1 of binding region 66 of the innermost media sheet (the top media sheet illustrated in FIGS. 10 and 11) is the narrowest while the width W1 of binding region 66 of each successive media sheet is slightly greater than the binding region of the prior sheet allowing that successive media sheet to fold around and nest the inner media sheet or sheets. Referring to FIG. 12, folds 68 and 70 of the outermost sheet of booklet 72 define binding edges 74 and 76 which in turn form the boundaries of spine 78 of booklet 72. First region 62 of the outer most sheet defines a first face of booklet 72 while second region 64 defines second face of booklet 72.

Figure 13:
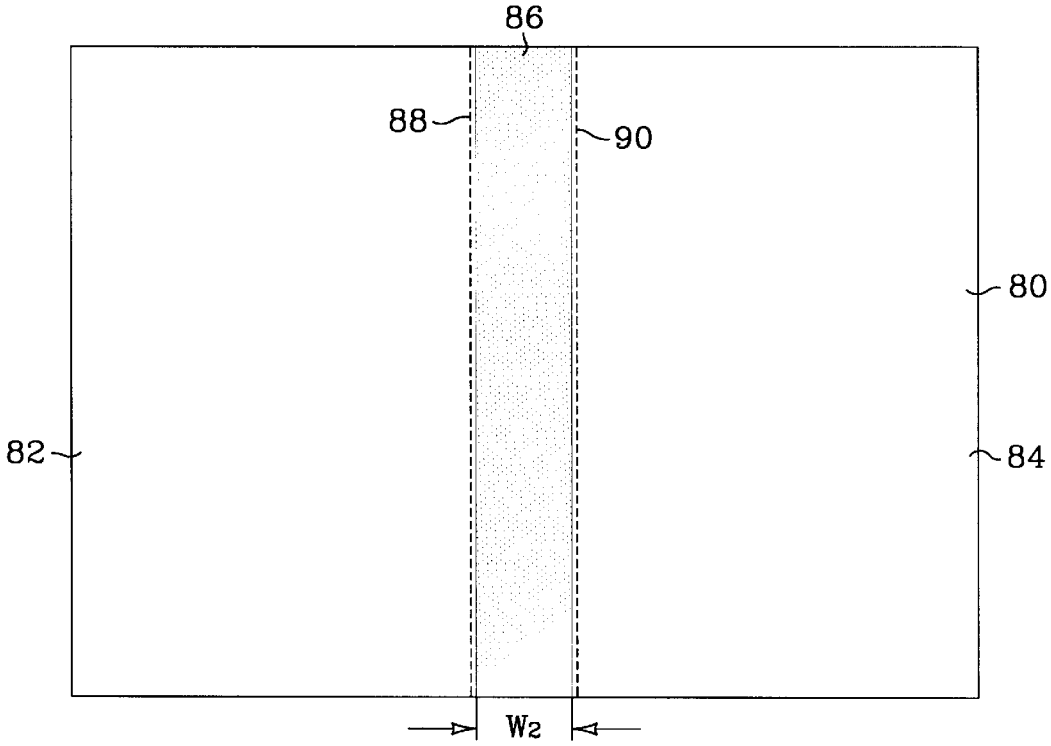

Referring now to FIG. 13, cover 80 includes first flap 82 and second flap 84. Spine 86 is located between and joins first and second flaps 82 and 84. First fold 88 is located along the intersection of first flap 82 and spine 86. Second fold 90 is located along the intersection of second flap 84 and spine 86. Cover 80 is initially passed through an image forming device where imaging material, such as toner, is deposited on spine 86. Imaging material may also be deposited on one or both faces of cover 80 in the form of desired print images. The deposited imaging material is then activated or fused to cover 80.

Figure 14:
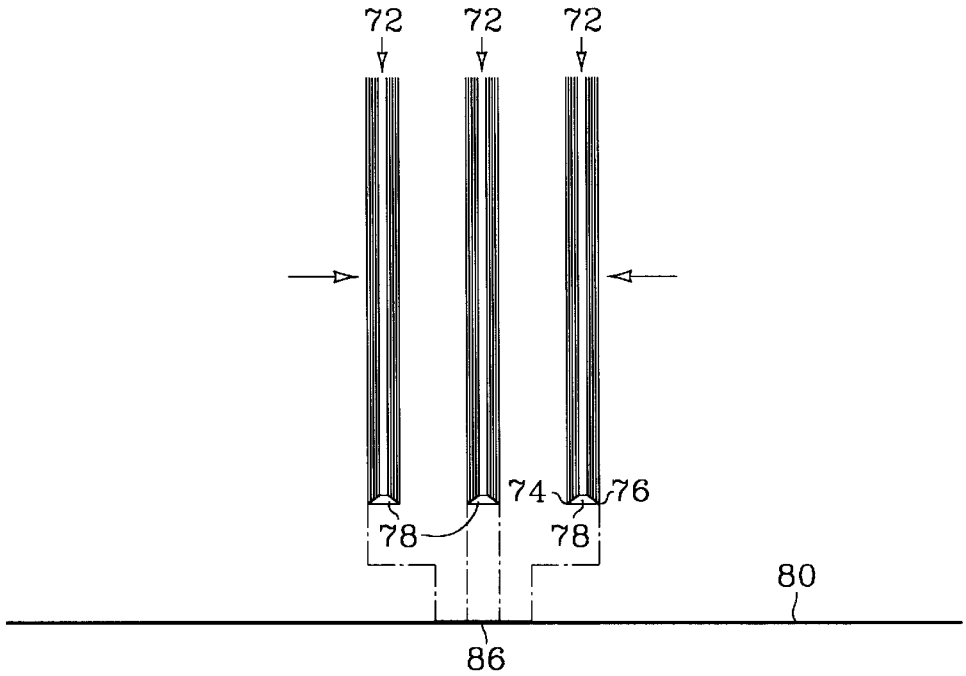
Figure 15:
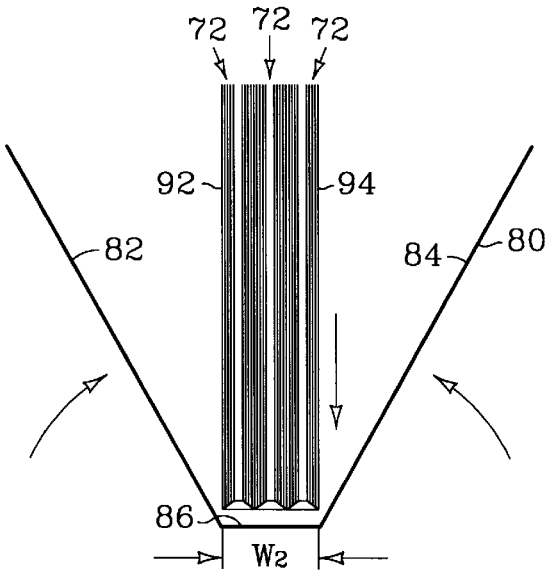
Figure 16:
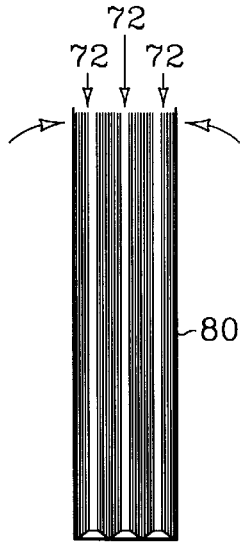

Referring now to FIGS. 14–16, cover 80 is assembled with and bound to a number of booklets 72. In FIG. 14, booklets 72 are assembled into a stack aligning binding edges 74 and 76 of each booklet 72 such that spines 78 share a common plane and at least one face of each booklet 72 is placed adjacent to a face of another booklet 72. The width W2 of cover spine 86 depends on the combined width of booklet spines 78.

In FIGS. 15 and 16, the stack of booklets 72 are assembled with and bound to cover 80. Cover 80 is wrapped around the stack of booklets 72. First flap 82 of cover 80 extends across a first exposed face 92 of one booklet 72 while second flap 84 of cover 80 extends across a second exposed face 94 of another booklet 72. Spine 86 of cover 80 is then pressed against spines 78 of booklets 72 and the imaging material deposited on spine 86 is reactivated binding cover 80 to booklets 72, thus, forming book 96.

The present invention has been shown and described with reference to the foregoing exemplary embodiments. It is to be understood, however, that other forms, details, and embodiments may be made without departing from the spirit and scope of the invention which is defined in the following claims.

What is claimed is:

1. A book, comprising a stack of media sheets, each media sheet having at least one binding region and one binding edge, the binding region being located adjacent to the binding edge;

a cover extending at least partially over a first face of the stack, wrapping around the binding edges of the media sheets, and extending at least partially over a second face of the stack;

activated imaging material on the binding region of each media sheet binding the media sheets together; and activated imaging material on the cover binding the cover to the binding regions on the first and second faces of the stack.

2. The book of claim 1, wherein the binding region of each media sheet is aligned with and faces a binding region of an adjacent media sheet.

3. The book of claim 1, wherein the binding regions are strips located adjacent to and generally parallel with the binding edge of each media sheet.

4. The book of claim 1, further comprising activated imaging material on each media sheet and the cover in patterns of desired print images.

5. The book of claim 1, wherein the activated imaging material in the binding region of each media sheet and on the cover comprises reactivated imaging material.

6. The book of claim 1, wherein the cover further includes:

a first flap;

a second flap;

a first fold allowing the first flap to extend across the first face of the stack;

a second fold allowing the second flap to extend across the second face of the stack; and a spine located between the first and second folds abutting the binding edges of the media sheets.

7. The book of claim 6, wherein the first fold is aligned with the binding edge of the first face of the stack, and the second fold is aligned with the binding edge of the second face of the stack.

8. The book of claim 6, wherein the cover further includes a first score along the first flap binding region of the cover, and a second score along the second flap binding region of the cover, the scores being generally parallel with the first and second folds.

9. The book of claim 8, wherein at least a of portion of the activated imaging material on the cover is located between the first fold and the first score and another portion is located between the second fold and the second score, the imaging material on those portions binding, at least in part, the cover to the stack.

10. A book, comprising:

a stack of booklets, each having a first face, a second face, and a spine connecting a binding edge of the first face to a binding edge of the second face, one binding edge and one face of each booklet being aligned respectively with one binding edge and one face of an adjacent booklet;

a cover extending at least partially over a first exposed face of one booklet in the stack, wrapping around the spines of the stack of booklets, and extending at least partially over a second exposed face of another booklet in the stack; and activated imaging material binding the cover to the spines of each booklet in the stack.

11. The book of claim 10, wherein the spine of each booklet is a strip located between and generally parallel with the binding edges of that booklet.

12. The book of claim 10, wherein each booklet comprises a plurality of nested media sheets.

13. The book of claim 12, wherein each of the nested media sheets comprises:

a first region;

a second region;

a binding region joining the first region to the second region, a first fold along the intersection of the first region and the binding region, a second fold along the intersection of the second region and the binding region; and imaging material binding the binding region of that nested media sheet to the binding region of at least one adjacent nested media sheet.

14. The book of claim 13, wherein the binding region of each nested media sheet is a ship between and generally parallel with the first and second folds.

15. The book of claim 13, further comprising activated imaging material on each nested media sheet and the cover in patterns of desired print images.

16. A method of binding a book assembled from a stack of media sheets and a cover, the method comprising:

applying imaging material to a binding region of each sheet, the binding region located adjacent to a binding edge of that sheet;

assembling the sheets into at least one stack for binding, aligning the binding edges and binging regions of adjacent sheets in that stack;

applying imaging material to a binding region on the cover;

assembling the cover with the stack of media sheets; and activating the imaging material in the binding regions of each sheet and the cover binding together the sheets in the stack and binding the cover to the stack.

17. The method of claim 16, wherein the act of assembling the cover with the stack comprises:

extending the cover at least partially over the first face of the assembled stack;

wrapping the cover around the binding edges of the stack; and extending the cover at least partially over the second face of the stack.

18. The method of claim 16 wherein the act of activating the imaging material comprises reactivating the imaging material on the binding regions of the sheets after assembling the sheets into a stack and before assembling the cover with the stack.

19. The method of claim 16 wherein the act of activating the imaging material comprises simultaneously reactivating the imaging material on the binding regions of the sheets and the binding region of the cover.

20. The method of claim 16, further comprising applying imaging material in patterns of desired print images on each sheet and on the cover and activating the imaging material in the print patterns.

* * * * *

UNITED STATES PATENT AND TRADEMARK OFFICE

CERTIFICATE OF CORRECTION

PATENT NO. : 6,558,099 B2
DATED : May 6, 2003
INVENTOR(S) : Gabriel Mendoza et al.

It is certified that error appears in the above-identified patent and that said Letters Patent is hereby corrected as shown below:

Column 3,
Line 38, after "another" insert -- . --

Column 6,
Line 20, delete "ship" and insert therefor -- width --
Line 31, delete "binging" and insert therefor -- binding --

Signed and Sealed this

Second Day of August, 2005

JON W. DUDAS
*Director of the United States Patent and Trademark Office*